US008360894B2

(12) United States Patent
Hlynka

(10) Patent No.: US 8,360,894 B2
(45) **Date of Patent: *Jan. 29, 2013**

(54) WATERSLIDE BOWL

(76) Inventor: Marvin R. Hlynka, Richmond (CA)

( * ) Notice: Subject to any disclaimer, the term of this patent is extended or adjusted under 35 U.S.C. 154(b) by 217 days.

This patent is subject to a terminal disclaimer.

(21) Appl. No.: 12/840,105

(22) Filed: Jul. 20, 2010

(65) Prior Publication Data

US 2010/0285894 A1 Nov. 11, 2010

Related U.S. Application Data

(63) Continuation-in-part of application No. 11/848,300, filed on Aug. 31, 2007, now Pat. No. 7,780,537.

(51) Int. Cl.
*A63G 21/18* (2006.01)
*A63G 21/00* (2006.01)

(52) U.S. Cl. ..... 472/117; 472/128

(58) Field of Classification Search ..... 472/13, 472/116, 117, 128, 129; 104/53, 69, 70; 182/48, 49, 51

See application file for complete search history.

(56) References Cited

U.S. PATENT DOCUMENTS

| | | | | |
|---|---|---|---|---|
| 920,567 | A | 5/1909 | Hayes | |
| 1,511,139 | A | 10/1924 | Leo-Roziger | |
| 2,724,123 | A | 11/1955 | Kesler | |
| 4,836,521 | A * | 6/1989 | Barber | 472/13 |
| 5,326,328 | A | 7/1994 | Robinson | |
| 6,354,955 | B1 | 3/2002 | Stuart et al. | |
| 6,485,372 | B2 | 11/2002 | Stuart et al. | |
| 6,857,964 | B2 | 2/2005 | Hunter | |
| D521,098 | S | 5/2006 | Hunter | |
| 7,056,220 | B2 | 6/2006 | Hunter | |

FOREIGN PATENT DOCUMENTS

| | | |
|---|---|---|
| GB | 2 224 948 | 5/1990 |

* cited by examiner

*Primary Examiner* — Kien Nguyen

(74) *Attorney, Agent, or Firm* — Greenberg Traurig LLP

(57) ABSTRACT

An annular-shaped waterslide bowl for use as an element of a waterslide apparatus serves to slow a rider down and bring him or her to a stop at the end of the waterslide ride. The bowl has a bowl wall with a rider entry port through which a rider slides from a flume into the bowl. The bottom wall of the bowl has an opening at its center and a low circumferential wall around the opening extends upwardly from the bottom wall. The rider comes to a stop in the bowl and can step over the circumferential wall into the opening. A staircase or slide located within the opening provides means for the rider to exit the bowl. The waterslide bowl provides a compact structure for slowing and stopping the rider and is particularly suitable for waterslide installations having limited space.

20 Claims, 9 Drawing Sheets

WATERSLIDE BOWL

RELATED APPLICATIONS

This application is a Continuation-in-Part and claims the benefit of U.S. application Ser. No. 11/848,300 entitled "WATERSLIDE RUN-OUT BOWL," filed on Aug. 31, 2007 now U.S. Pat. No. 7,780,537, and which is hereby incorporated by reference in its entirety.

TECHNICAL FIELD

This invention pertains to waterslides, and, in particular, to a waterslide bowl in which the rider can come to a stop and exit by walking out, or sliding out of the waterslide bowl, leaving the ride.

BACKGROUND INFORMATION

Waterslides cause a rider to descend and travel through the slide structure at considerable speed and, indeed, the experience of speed is one of the attractions of this type of amusement ride. By the end of the ride, however, the rider must be brought to a full stop. A waterslide must therefore be designed so that a fast-moving rider is safely slowed down and brought to a stop.

Waterslides commonly have at their end part an elongated and gently sloping flume, which may be a tube or open channel, to provide a place in which the rider can slow down before coming to a stop, for example by dropping the rider into a pool or onto a soft mat. Flumes for this purpose require considerable space. Where the waterslide is subject to space limitations, for example a waterslide on a cruise ship, such elongated flume may not be feasible.

SUMMARY OF THE INVENTION

The invention provides a waterslide bowl for a waterslide, such as a waterslide run-out bowl, which bowl is adapted to slow a rider down and bring him or her to a stop. The bowl occupies substantially less space than an elongated flume and is especially suitable for use in waterslides having limited space, as on a cruise ship or in an indoor water park.

The waterslide bowl of the invention is an annular-shaped bowl comprising a bowl wall having a side wall portion and a bottom wall portion. A rider entry port permits sliding entry of a rider into the bowl. The bottom wall portion has an opening at its center. A circumferential wall around this center opening extends upwardly from the bottom wall portion and at least part of it is capable of being stepped over by the rider. A bowl exit means, such as a staircase or slide, is provided for the rider to exit the waterslide from the center opening. The staircase can extend upwardly or downwardly, depending on the desired configuration of the waterslide bowl.

The waterslide bowl of the invention is one element in a waterslide apparatus. Such apparatus includes a flume leading into the bowl and other upstream ride elements, depending on the design choices made for a particular application.

The waterslide bowl can be used by a rider using no ride-on device (i.e. where the waterslide is a body slide) or by a rider using an inner tube, mat or other device.

In one embodiment, the present invention includes a waterslide bowl adapted for use as part of a waterslide apparatus, including a bowl wall having a side wall portion and a bottom wall portion, the bottom wall portion defining a center opening at its center, a rider entry port for sliding entry of a rider into the bowl, a circumferential wall about the center opening extending upwardly from the bottom wall portion, at least part of the circumferential wall being capable of being stepped over by the rider, and a bowl exit means for the rider to exit from the center opening, wherein the bowl exit means comprises a staircase.

In another embodiment, the present invention is a waterslide bowl adapted for use as part of a waterslide apparatus, including a bowl wall having a side wall portion and a bottom wall portion, the bottom wall portion defining a center opening at its center, a rider entry port for sliding entry of a rider into the bowl, a circumferential wall about the center opening extending upwardly from the bottom wall portion, at least part of the circumferential wall being capable of being stepped over by the rider, and a bowl exit means for the rider to exit from the center opening, wherein the bowl exit means comprises a slide.

In yet another embodiment, the present invention includes a tilted waterslide bowl adapted for use as part of a waterslide apparatus, including a tilted bowl wall having a side wall portion and a bottom wall portion, the bottom wall portion defining a center opening at its center, a rider entry port for sliding entry of a rider into the bowl, a circumferential wall about the center opening extending upwardly from the bottom wall portion, the circumferential wall having an upper edge that is spaced from the bottom wall portion about the entirety of the circumferential wall, at least part of the circumferential wall being capable of being stepped over by the rider, and a bowl exit means for the rider to exit from the center opening.

These and other features of the invention will be apparent from the following description and drawings of the preferred embodiments.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

Exemplary embodiments are illustrated in referenced figures of the drawings. It is intended that the embodiments and figures disclosed herein be considered illustrative rather than restrictive.

DESCRIPTION OF THE PREFERRED EMBODIMENTS

Figure 1:
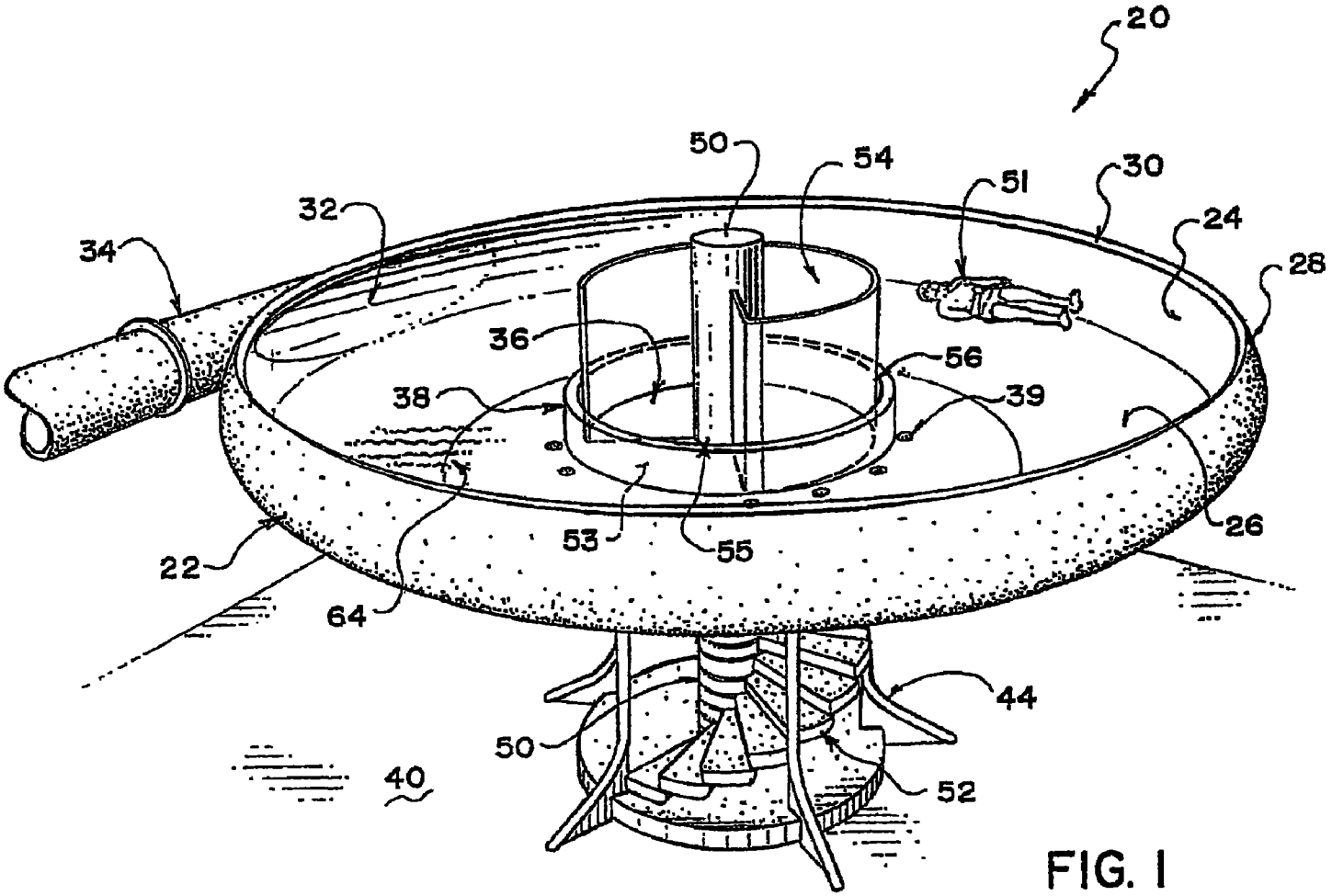
FIG. 1 is a top perspective view of a waterslide bowl according to an embodiment of the present invention.
Figure 2:
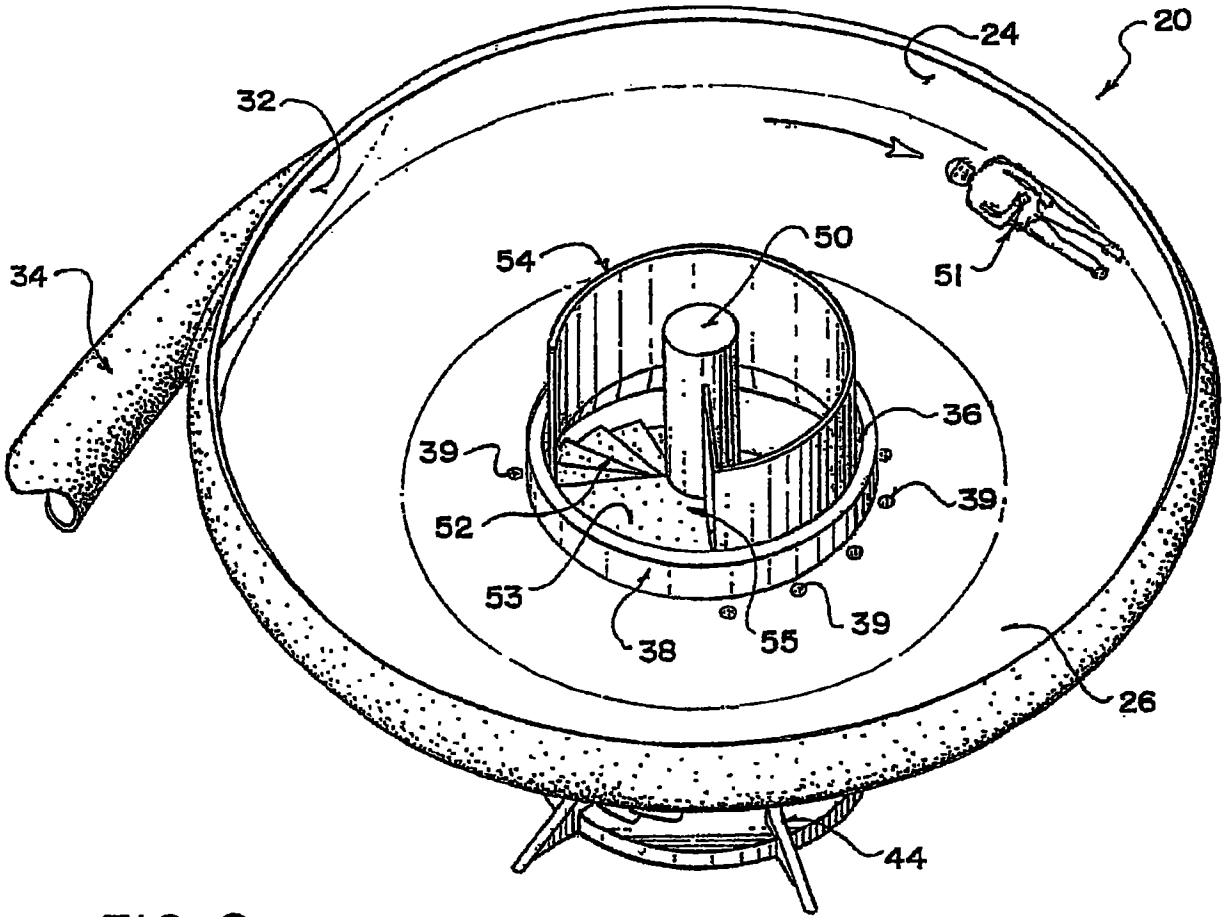
FIG. 2 is a top perspective view of a waterslide bowl according to an embodiment of the invention.
Figure 3:
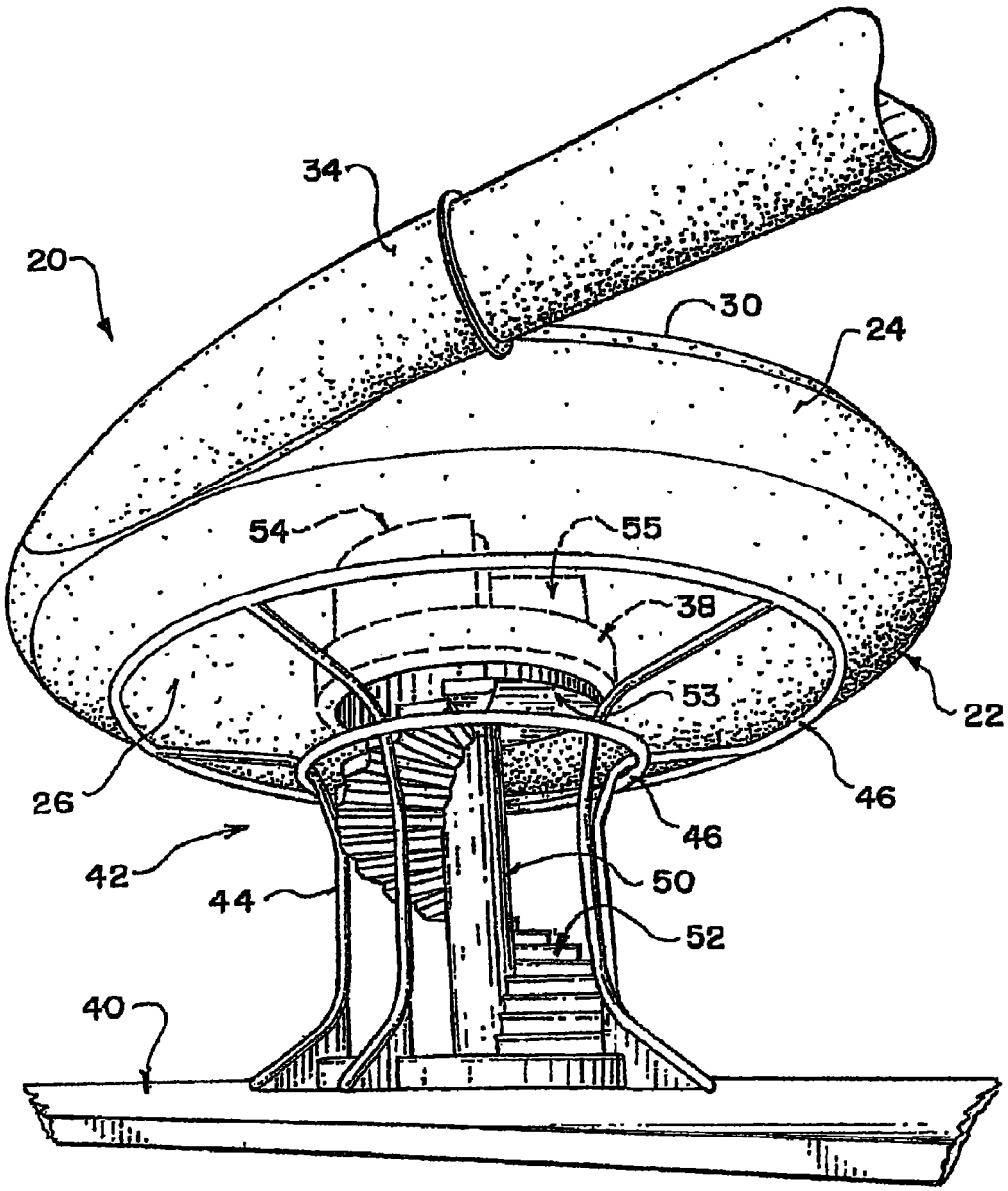
FIG. 3 is a bottom perspective view of the waterslide bowl of FIG. 1.

Referring first to FIGS. 1 to 3, the waterslide bowl 20 is an annular-shaped element which forms part of a waterslide ride apparatus having ride elements upstream of the bowl. The waterslide bowl 20 can be, for example, a waterslide run-out bowl.

The bowl 20 has a bowl wall 22 having a side wall portion 24 and a bottom wall portion 26. These portions form a continuous, curved wall structure with no clear line of demarcation between the side wall and bottom wall portions. The side wall portion 24 is relatively steep and curved and includes an inwardly-turning portion 28 at its rim 30. The bottom wall portion 26 is gently curved and has a shallower angle from the horizontal than the side wall portion 24.

A rider entrance port 32 is in the side wall portion 24 near the rim 30. A rider 51 slides into the bowl 20 through this entrance from a flume 34 leading from a higher elevation.

The bottom wall portion 26 defines an opening 36 at its center, such that the bowl wall 22 forms an annulus around the opening 36. A circumferential wall 38 about the opening 36 extends upwardly from the bottom wall portion 26. The wall 38 is low enough that the rider, standing on the bottom wall portion next to the circumferential wall 38, can step over it into the opening 36.

The bowl 20 is supported above a floor 40 by a support framework 42 which comprises vertical members 44 and bowl-support members 46 which are arranged under the underside of the bowl wall 22.

A circular staircase is arranged within the support framework 42, extending from the opening 36 in the bottom wall portion 26 to the floor 40. The staircase comprises a central vertical post 50, a landing 53 at the top of the staircase and stairs 52. The landing 53 is at the same height as the bottom wall portion 26 adjacent to the circumferential wall 38.

A guard structure 54 extends upwardly from the circumferential wall 38 around three-quarters of the circumference of the opening 36, so that only a portion 55 of the wall 38 can be stepped over. The landing 53 is adjacent to this portion 55 so that the rider can step over the wall 38 and onto the landing 53. The guard 54 is a plexiglass barrier that prevents the rider from stepping over the other portion 56 of the wall where the landing 53 is not adjacent, for reasons of rider safety.

Water flows continuously into the bowl through the entry flume 34, which reduces friction and facilitates the rider sliding through the flume 34. A water pipe with a plurality of jets (not shown) placed below the rim 30 also provides a continuous supply of water to the bowl to wet its sides, reducing friction between the rider and the walls of the bowl. The water from these sources replenishes a volume of water 64 on the bottom of the bowl, adjacent to and held in by the circumferential wall 38. It has a depth of about 2 to 4 inches adjacent to the wall 38. Water drainage openings 39 are provided at the base of the circumferential wall 38 to prevent the water level in the bowl from rising above the desired height. The openings are connected to a trap to regulate the water level and a drainage system (not shown) for removing the water.

Figure 4:
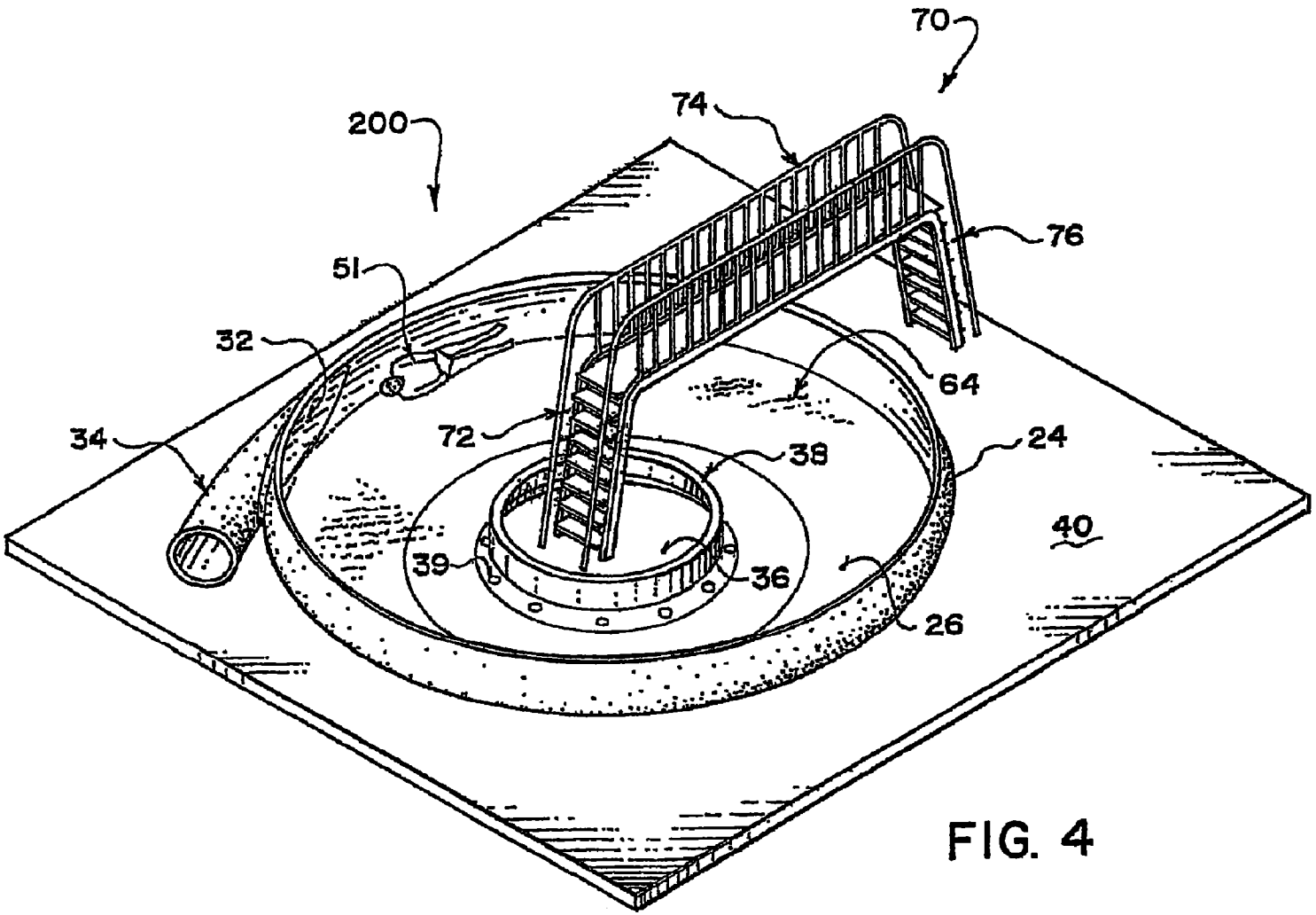
FIG. 4 is a perspective view of an embodiment of the waterslide bowl.

FIG. 4 illustrates an embodiment of the invention in which the waterslide bowl 200 is positioned on or close to the floor rather than being supported above it as in the embodiment of FIG. 1. In FIG. 4, features that correspond to or are the same as features of the bowl 20 are indicated by like reference numerals. The bowl 200 has essentially the same structure as the bowl 20 except that it is adapted for a rider to exit from the opening 36 in the bottom wall portion 26 by traversing over the bowl wall 22.

The bowl 200 is supported on the floor 40 by a suitable support frame (not shown). A walkway 70 extends between the floor 40 inside the opening 36 and the floor radially outward from the bowl 200. The walkway comprises a first staircase section 72, a horizontal walkway section 74 and a second staircase section 76. Since the floor 40 inside the opening 36 is close to the level of the bottom wall portion 26 adjacent to the circumferential wall 38, the bowl 200 does not require any safety guard around part of the wall 38. The rider can step over the wall 38 at any point and then exit the waterslide by means of the walkway 70.

The bowl 20 is fabricated from a plurality of sections of a suitable and durable material, such as fiberglass, fastened together to form a strong, rigid structure. A liner may be applied to the inner surface to provide a continuous, smooth interior surface that will facilitate a rider's sliding movement.

The bowl may have a depth of about 5 feet and a diameter of about 30 feet. The height of the center wall 38 is about 2 feet. The inner diameter of the flume 34 is in the range of about 2.5 to 4 feet.

Figure 5:
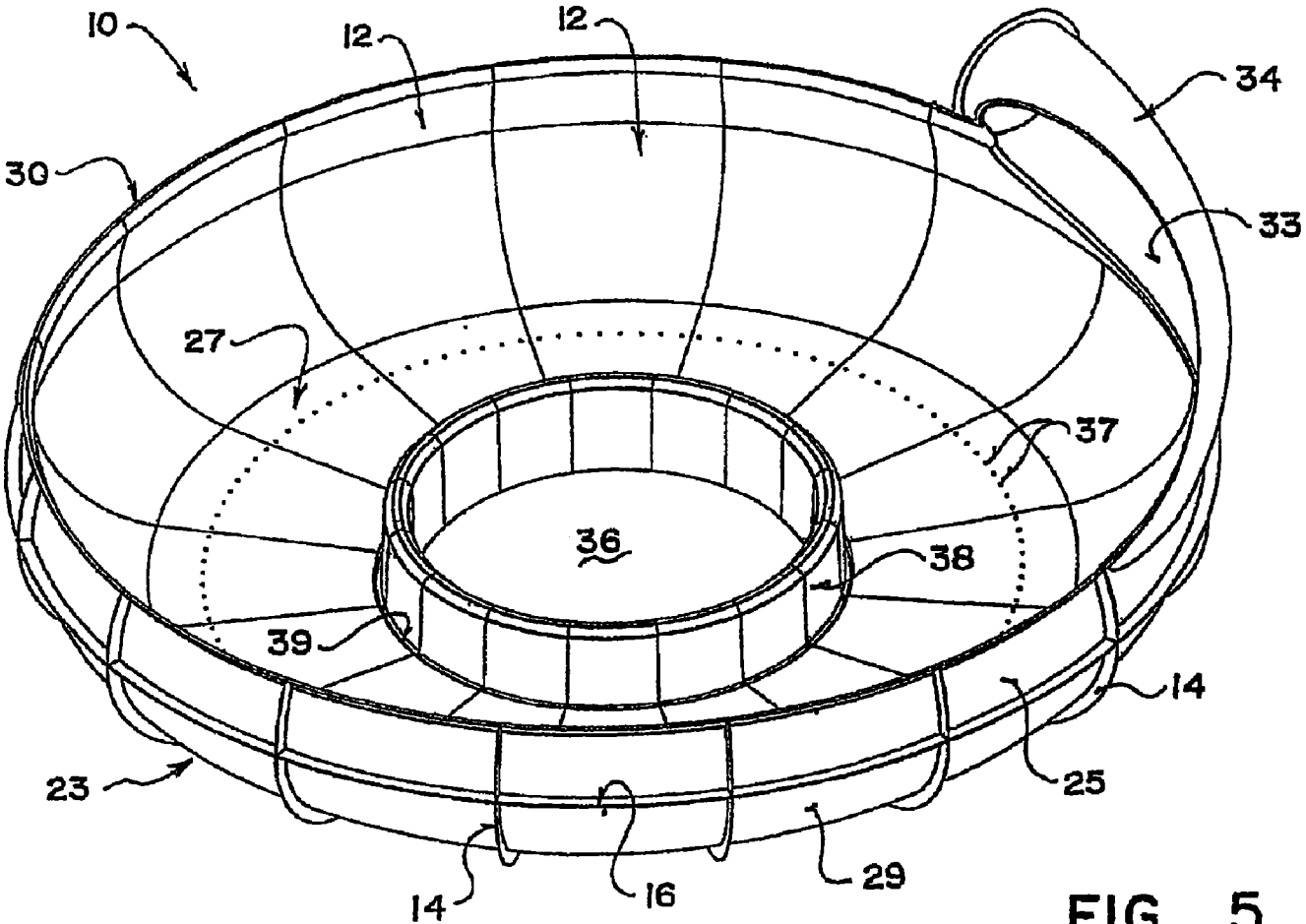
FIG. 5 is a perspective view of an embodiment of the waterslide bowl.

FIG. 5 illustrates an embodiment of the run-out bowl (the staircase, guard and supports are not illustrated) which can be used in place of the bowl 20 in the elevated structure of FIG. 1 or the on-floor structure of FIG. 4. The bowl 10 is constructed of a plurality of segments 12. The bowl wall 23 has an upper side wall portion 25 and a lower side wall portion 29, and a bottom wall portion 27. The entry port 33 leading into the bowl 10 from the flume 34 is partly raised above the level of the rim 30 of the bowl. The bowl wall is supported by vertical ribs 14 and a horizontal rib 16. Water drainage openings 39 are provided at the base of the circumferential wall 38. A ring of spray holes 37 is provided in the bottom wall portion 27 for spraying water into the bowl.

Figure 6:
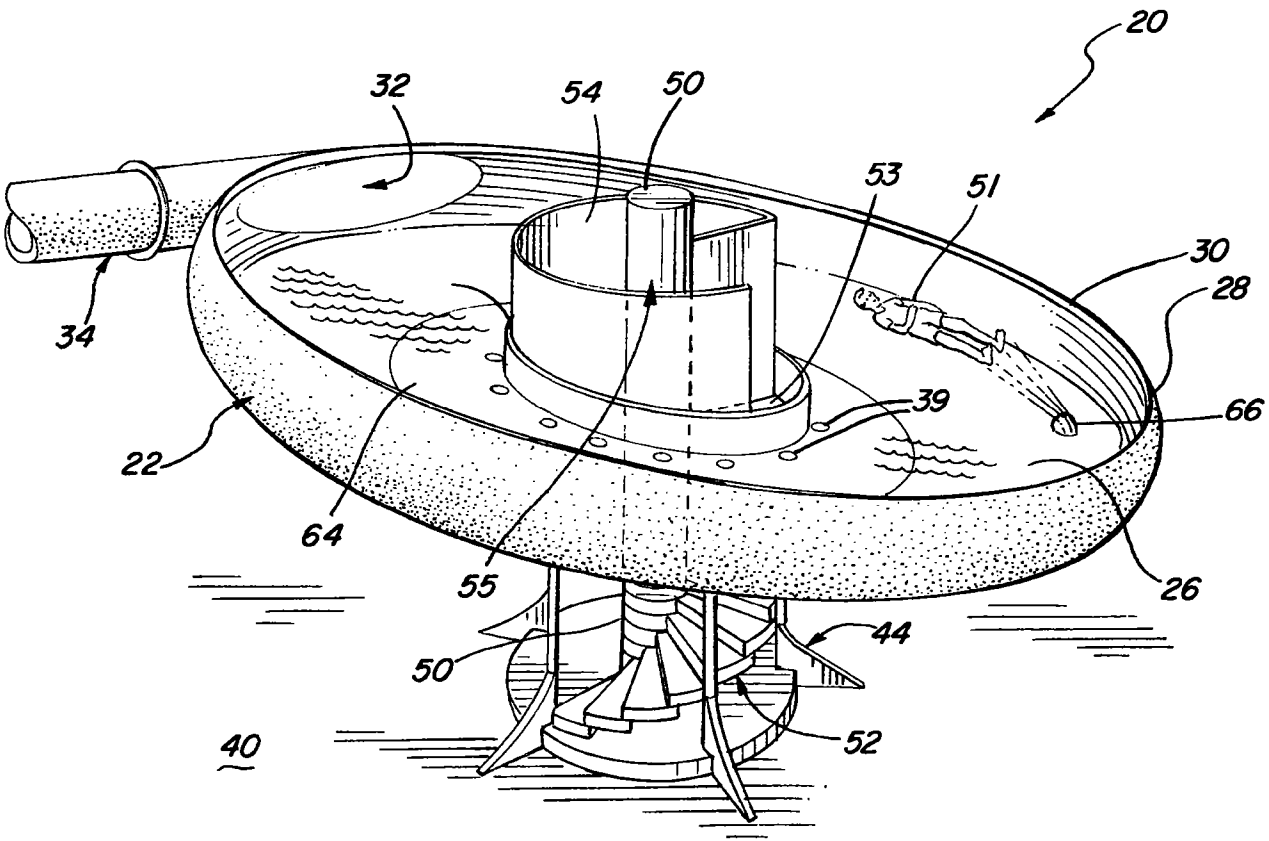
FIG. 6 is a perspective view of a tilted waterslide bowl according to an embodiment of the present invention.

FIG. 6 illustrates an embodiment of the invention in which the waterslide bowl 20 is tilted. The tilted waterslide bowl 20 can have, for example, a titled bowl wall 22. The tilted waterslide bowl 20 has a high portion and a low portion. The high portion is elevated above the low portion. Thus, the rider 51 moves from the high portion to the low portion and back towards the high portion. However, due to the tilt of the waterslide bowl 20, gravity slows down the rider 51 as he moves from the low portion back towards the high portion. This can reduce a number of times the rider 51 traverses around the waterslide bowl 20. In one embodiment, the rider 51 does not completely move from the low portion back to the high portion. Instead, at some point the rider 51 can slide back down towards the low portion due to gravity. In another embodiment, optional nozzles such as nozzle 66 can be used to spray water onto the rider 51, thereby slowing the rider 51 down further. Any number of nozzles can be used, and they can be strategically placed to slow down the rider 51. By reducing the number of times the rider 51 traverses around the waterslide bowl 20, the rider 51 can exit the waterslide bowl 20 in a more expedient manner. This increases a number of people that can utilize the waterslide bowl 20 for a given period of time.

Figure 7:
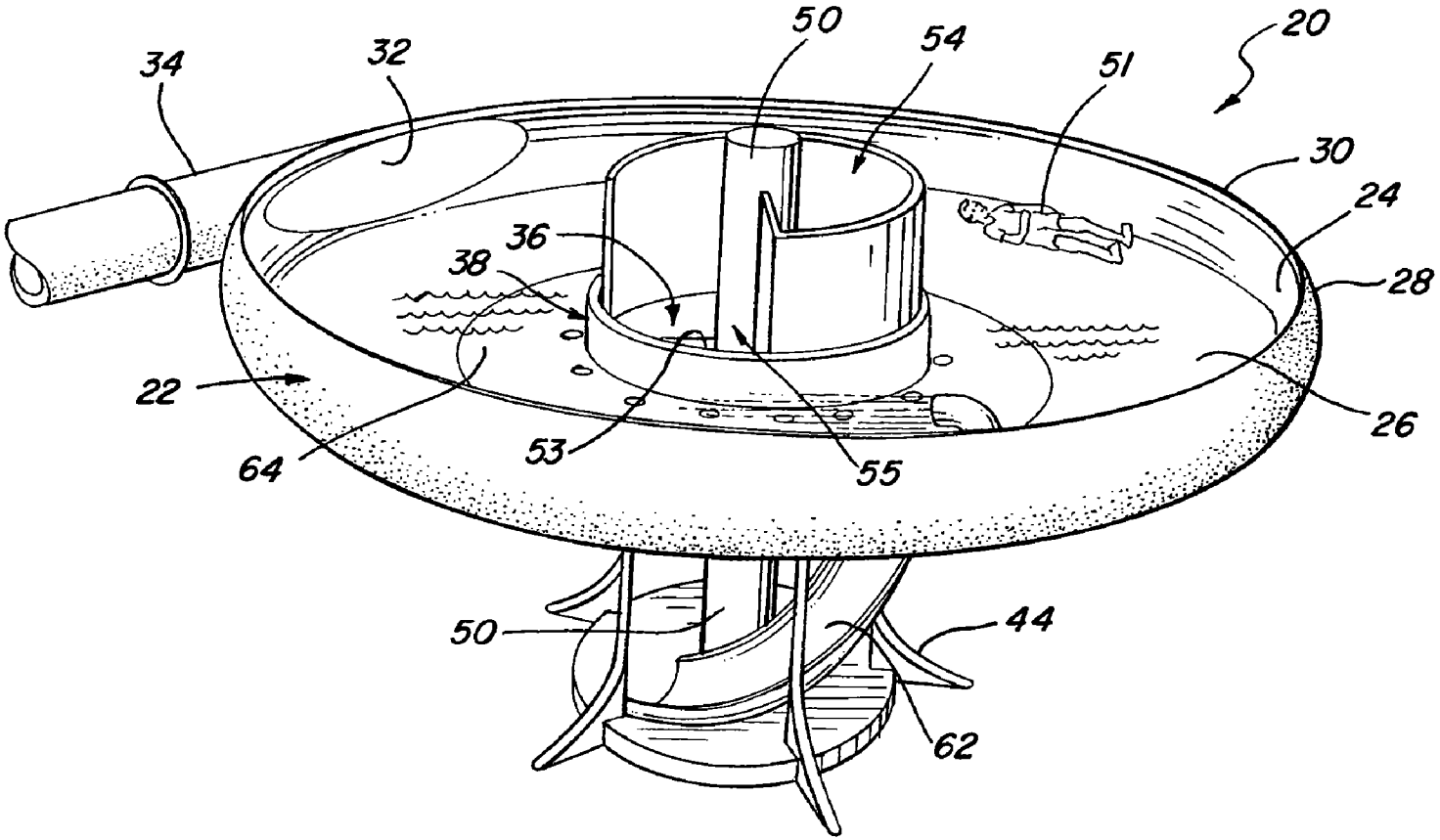
FIG. 7 is a perspective view of a waterslide bowl including a slide according to an embodiment of the present invention.
Figure 8:
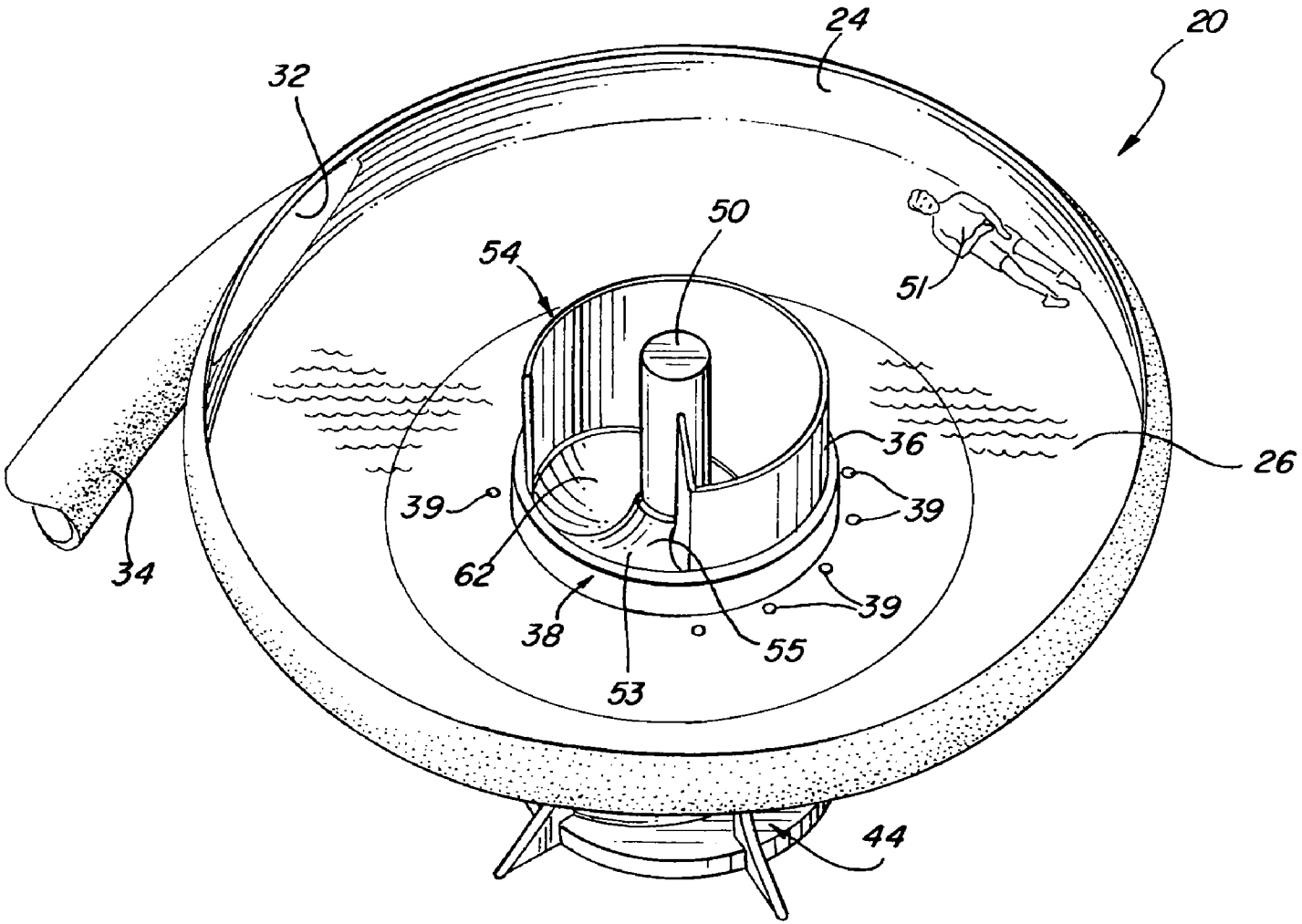
FIG. 8 is a top perspective view of a waterslide bowl including a slide according to an embodiment of the present invention.

FIG. 7 and FIG. 8 illustrate an embodiment of the invention in which the waterslide bowl 20 includes a slide 62 instead of the stairs 52. In one embodiment, the slide 62 can be a wet slide. In another embodiment, the slide 62 can be a substantially dry slide. A dry slide can slow down a rider 51 faster than a wet slide since the contact of the wet rider with the dry slide can create more friction than the contact of the wet rider with the wet slide. The slide 62 allows the rider 51 to exit the waterslide bowl 20 by sliding down the slide 62 instead of walking down the staircase 52. Thus, the rider 51 can step over the circumferential wall 38 onto the landing 53 and slide down the slide 62. Sliding down the slide 62 can reduce the time it takes for the rider 51 to exit the waterslide bowl 20. This can also increase a number of people that can utilize the waterslide bowl 20 for a given period of time. Furthermore, since the rider 51 is already substantially slowed down through the circular or curved nature of the titled waterslide bowl 20, the slide 62 can have a shorter length than conventional elongated flumes.

Figure 9:
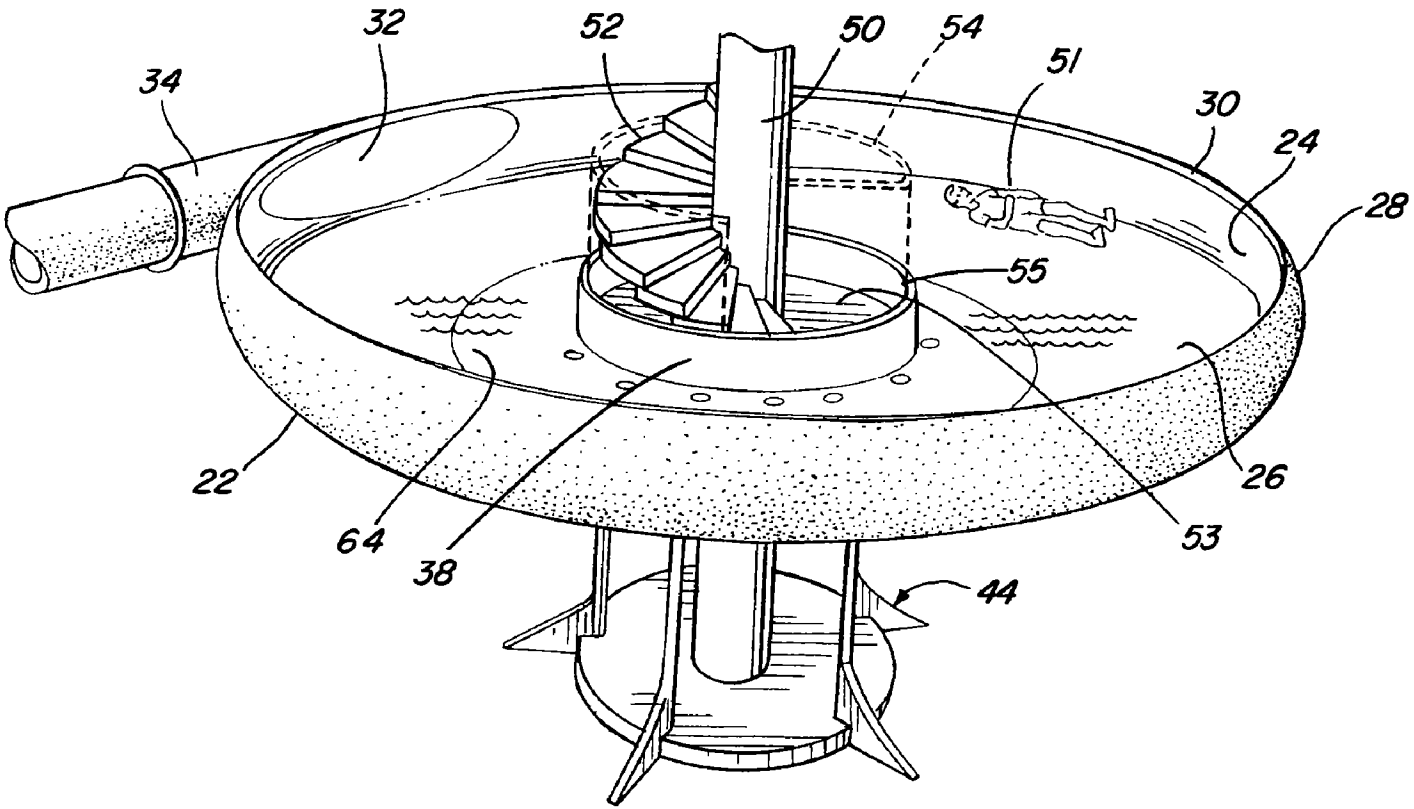
FIG. 9 is a perspective view of a waterslide bowl including a staircase extending upwardly according to an embodiment of the present invention.

FIG. 9 illustrates an embodiment of the invention in which the staircase 52 extends upwards instead of downwards as seen in FIG. 1. Furthermore, instead of utilizing the horizontal walkway section 74 in the walkway 70 (FIG. 4), only the staircase 52 is utilized. Although the staircase 52 is depicted as extending upwardly in a spiral configuration, it can be formed in a variety of configurations. In one embodiment, the staircase 52 is configured to resemble the first staircase section 72 in FIG. 4. By having the staircase extend upwardly instead of downwardly, other configurations are provided for the waterslide bowl 20 which can be utilized, for example, where it may be undesirable for the rider 51 to exit below the bowl 24. In another embodiment, the staircase 52 can be angled to obviate the need for the walkway 70.

Instead of using a slide 52 or the staircase 52, the waterslide bowl 20 can also include, for example, a pole such as a fireman's pole. This can allow the rider to slide down the pole to exit the waterslide bowl 20. In addition, a ramp can also be used instead of the slide 62 or the staircase 52. The rider can walk down the ramp or slide down the ramp.

Although the invention has been described in terms of various embodiments, it is not intended that the invention be limited to these embodiments. Various modifications within the scope of the invention will be apparent to those skilled in the art. For example, the bowl exit means can comprise any practical means for a rider to exit the bowl, for example a slide, tube, etc. leading into a pool of water or to a mat. The scope of the invention is defined by the claims that follow.

What is claimed is:

1. A waterslide bowl adapted for use as part of a waterslide apparatus, comprising:

a bowl wall having a side wall portion and a bottom wall portion, the bottom wall portion defining a center opening at its center;

a rider entry port for sliding entry of a rider into the bowl;

a circumferential wall about the center opening extending upwardly from the bottom wall portion, at least part of the circumferential wall being capable of being stepped over by the rider; and a bowl exit means for the rider to exit from the center opening, wherein the bowl exit means comprises a staircase.

2. The waterslide bowl of claim 1 wherein the staircase extends upwardly from the center opening.

3. The waterslide bowl of claim 2 wherein the staircase comprises a landing at a bottom end of the staircase.

4. The waterslide bowl of claim 3 further comprising a guard structure adjacent to the circumferential wall, the guard structure being open adjacent to the landing for passage by the rider.

5. The waterslide bowl of claim 2 wherein the circumferential wall has a first part thereof that is capable of being stepped over by the rider and a second part that is not capable of being stepped over by the rider, and the first part is adjacent to a landing at a bottom end of the staircase.

6. The waterslide bowl of claim 2 wherein the staircase is a circular staircase.

7. The waterslide bowl of claim 1 wherein the circumferential wall surrounds the bowl exit means to preclude a rider from sliding into the bowl exit means.

8. The waterslide bowl of claim 1 wherein the circumferential wall extends 360° around the bowl exit means.

9. A waterslide bowl adapted for use as part of a waterslide apparatus, comprising:

a bowl wall having a side wall portion and a bottom wall portion, the bottom wall portion defining a center opening at its center;

a rider entry port for sliding entry of a rider into the bowl;

a circumferential wall about the center opening extending upwardly from the bottom wall portion, at least part of the circumferential wall being capable of being stepped over by the rider; and a bowl exit means for the rider to exit from the center opening, wherein the bowl exit means comprises a slide.

10. The waterslide bowl according to claim 9 wherein the slide extends downwardly from the center opening.

11. The waterslide bowl of claim 10 wherein the slide comprises a landing at a top end of the slide.

12. The waterslide bowl of claim 11 further comprising a guard structure adjacent to the circumferential wall, the guard structure being open adjacent to the landing for passage by the rider.

13. The waterslide bowl of claim 9 wherein the circumferential wall has a first part thereof that is capable of being stepped over by the rider and a second part that is not capable of being stepped over by the rider, and the first part is adjacent to a landing at a top end of the slide.

14. The waterslide bowl of claim 9 wherein the circumferential wall surrounds the bowl exit means to preclude a rider from sliding into the bowl exit means.

15. The waterslide bowl of claim 9 wherein the circumferential wall extends 360° around the bowl exit means.

16. A tilted waterslide bowl adapted for use as part of a waterslide apparatus, comprising:

a tilted bowl wall having a side wall portion and a bottom wall portion, the bottom wall portion defining a center opening at its center;

a rider entry port for sliding entry of a rider into the bowl;

a circumferential wall about the center opening extending upwardly from the bottom wall portion, the circumferential wall having an upper edge that is spaced from the bottom wall portion about the entirety of the circumferential wall, at least part of the circumferential wall being capable of being stepped over by the rider; and a bowl exit means for the rider to exit from the center opening.

17. The waterslide bowl of claim 16 wherein the bowl exit means comprises a staircase.

18. The waterslide bowl of claim 16 wherein the bowl exit means comprises a slide.

19. The waterslide bowl of claim 16 wherein the bowl exit means comprises a landing at a top end of the bowl exit means, and a guard structure adjacent to the circumferential wall, the guard structure being open adjacent to the landing for passage by the rider, wherein the circumferential wall has a first part thereof that is capable of being stepped over by the rider and a second part that is not capable of being stepped over by the rider, and the first part is adjacent to the landing.

20. The waterslide bowl of claim 16 further comprising a nozzle spraying water to reduce a speed of the rider.

* * * * *